United States Patent [19]

De Roeck et al.

[11] 4,097,323

[45] Jun. 27, 1978

[54] BUTT-SPLICER

[75] Inventors: Joseph Irma De Roeck, St. Katelijne-Waver; Lucien Antoine Christiaen, Wilrijk, both of Belgium

[73] Assignee: Agfa-Gevaert N.V., Mortsel, Belgium

[21] Appl. No.: 692,146

[22] Filed: Jun. 2, 1976

[30] Foreign Application Priority Data

Jun. 4, 1975 United Kingdom ..... 24140/75

[51] Int. Cl.[2] ..... B65H 19/08

[52] U.S. Cl. ..... 156/159; 156/504; 156/505; 242/58.5

[58] Field of Search ..... 156/157, 159, 304, 502, 156/504, 505, 506, 545; 242/58.1, 58.4, 58.5; 29/225

[56] References Cited

U.S. PATENT DOCUMENTS

| | | | |
|---|---|---|---|
| 2,320,657 | 6/1943 | Roesen | 156/157 |
| 3,306,801 | 2/1967 | Giles | 156/504 X |
| 3,489,628 | 1/1970 | Catzen | 242/58.1 X |
| 3,549,458 | 12/1970 | Osta | 156/505 |
| 3,654,035 | 4/1972 | Takimoto | 156/504 |
| 3,717,057 | 2/1973 | Takimoto | 156/159 |
| 3,939,031 | 2/1976 | Takimoto | 156/505 |

*Primary Examiner*—David Klein
*Assistant Examiner*—Jerome W. Massie
*Attorney, Agent, or Firm*—William J. Daniel

[57] ABSTRACT

A butt-splicer for butt-joining a fresh web to a progressing web, wherein the progressing web is pulled about a web-supporting roller and the fresh web is introduced between the progressing web and the web-supporting roller, and the cutting, and the taping of both webs occur within the angle of wrapping about the web-supporting roller, thereby to produce accurate splices.

7 Claims, 7 Drawing Figures

BUTT-SPLICER

The present invention relates to a butt-splicer and to a butt-splicing method for butt-joining a fresh web to a progressing or running web without interrupting the motion of the progressing web.

Apparatus known in the art for carrying out the web-splicing comprise means for cutting through the two webs while they are in overlapping relation to form abutting ends, means for removing one web extremity during the further travelling of the webs and a tape applicator for applying a tape on the two abutting web ends at the side of the webs where the one extremity has been removed.

It has been shown that it is often difficult to make correct splices by means of the mentioned apparatus under critical conditions such as high web velocities, thin webs, webs with a tendency to curl, etc. It is believed that the main factor which is responsible for such occasional less satisfactory results is the uncontrolled path of both freshly cut web ends between the cutting station and the taping station so that due to friction of the web ends, especially that of the leading end of the fresh web, against a stationary intermediate table or support surface, and to curvature of the web ends under the influence of gravity or of inherent curling tendency, etc., correct registration of both web ends may be disturbed at the moment of taping.

The present invention provides a butt-splicing method wherein the path of the two webs between the operations of cutting and taping is carefully controlled so that accurate butt joints of more consistent quality may be obtained.

Broadly, the method according to the invention is characterised in that an end of the fresh web is introduced between the running web and a web-supporting roller while the the running web is guided being along a path extending through an arc of less than 360° around the roller periphery, and the two webs are cut through simultaneously and then taped together within the zone where they are supported on such roller. Thus the leading end portion of the fresh web is first brought into a given position in relation to the progressing web by becoming pressingly engaged between the running web and said web supporting roll and both the cutting and taping operations occur within the zone where the moving webs remain supported by such roller, in firm face to face contact with each other. Cutting and taping are achieved at positions spaced from each other around the periphery of said web-supporting roller, by means of cutting means and a tape applicator while these are caused to rotate at the same linear speed as the speed of movement of the supported web portions.

It is also an object of the present invention to provide a butt-splicer by which such a method can be performed.

Preferred but optional features of the apparatus according to the invention are as follows.

The web-supporting roller is a vacuum roller.

The angular extent over which the webs are wrapped about the web-supporting roller is at least 90 and preferably 180 angular degrees.

The web-supporting roller is positively driven at a peripheral speed corresponding with the linear speed at which the progressing web is transported.

The line of cutting and of taping of the webs makes a small angle with respect to the transverse direction of the webs, for instance an angle comprised between 2° and 10°.

The invention will be described hereinafter by way of example with reference to the accompanying drawings wherein:

FIG. 1 is a diagrammatic illustration of a web handling arrangement that comprises a butt splicer in accordance with the present invention.

FIGS. 2, 3 and 4 diagrammatically illustrate different positions of the butt-splicer during its operation.

Figure 1:
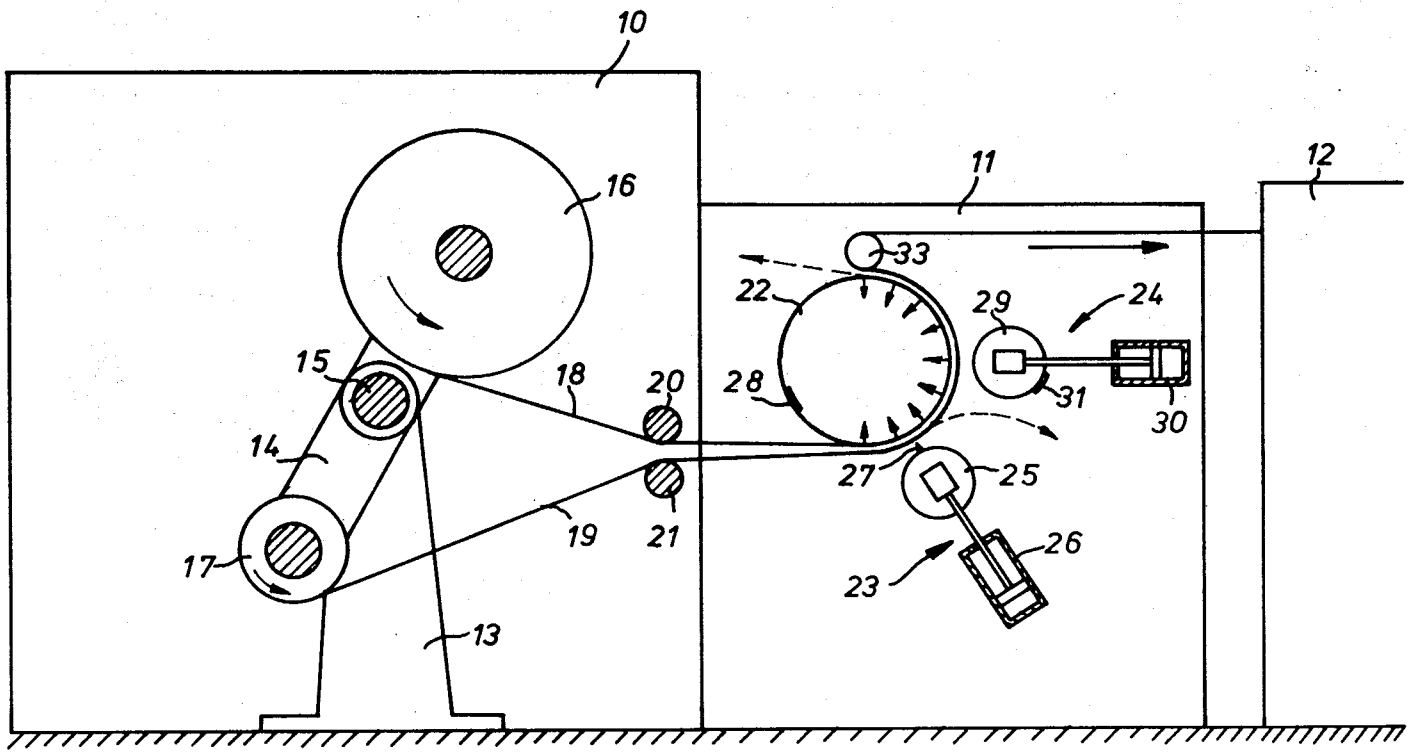

Referring to FIG. 1, the arrangement for handling a web comprises a web unwinding station 10, a web joining station 11, and a station 12 wherein the web may undergo any desired treatment such as coating, calendering, printing, edge trimming, etc.

The web unwinder 13 of station 10 is a conventional mechanism comprising two laterally spaced arms, such as the arm 14 shown, which may pivot about trunnions such as the trunnions 15, and which rotatably carry at their extremities rolls of webs, the roll 16 carrying the fresh web 18 and the roll 17 carrying the running web 19. Rollers 20 and 21 guide the webs along appropriate paths towards the station 11.

The butt-splicer of station 11 comprises a rotatable web-supporting vacuum roller 22 which is capable of establishing a reduced pressure at its peripheral surface over an angular extent of about 180° as indicated by the series of small arrows, as well as a cutter 23 and a tape applicator 24. The cutter 23 comprises a roller 25 which is mounted for translation towards and away from the vacuum roller and the position of which is controlled by a device such as the hydraulic cylinder 26. The roller 25 is provided at its periphery with a cutter 27 which may co-operate with a base plate 28 which is provided at the periphery of the vacuum roller 22, for simultaneously cutting both webs transversely while they are supported on said roller.

The knife 27 is not perfectly straight but, on the contrary, it is very slightly helicoidally curved about the roller 25 so that a line of cut of the webs is obtained that makes an angle of about 3° with respect to the transverse direction of the webs.

The tape applicator 24 comprises a roller 29 that is equally mounted for translation towards and away from the vacuum roller 22 and the position of which may be controlled by a device such as an hydraulic cylinder 30. The roller is provided with means known in the art, such as clamps, a vacuum board, etc., for holding a length of pressure-sensitive tape 31 on its surface, with the adhesive side of the tape facing outwardly, at a helicoidal position corresponding with the angle of cutting.

The rollers 25 and 29 are rotationally coupled with each other so that they take a well-determined relative angular position, and they are also provided with coupling means for coupling them at the desired moment with the vacuum roller 22 so that they may rotate at the same peripheral speed as said roller and also at a well-determined angular position with respect to said roller in order that the cutting knife 27 may co-operate with the base plate 28. Said coupling and drive means may comprise universal joint driving shaft mechanisms for rotating the rollers 25 and 29 during their bodily displacement, and a clutch mechanism that may be electrically, mechanically or pneumatically controlled for rotationally coupling said rollers with the vacuum roller at a determined relative angular relationship. All such mechanisms are known in the art and hence no detailed description of any particular mechanism for performing the desired function is given in the present description.

The operation of the butt-splicer is now explained with reference to the FIGS. 2 to 4, which illustrate different positions of the various parts of the apparatus.

Figure 2:
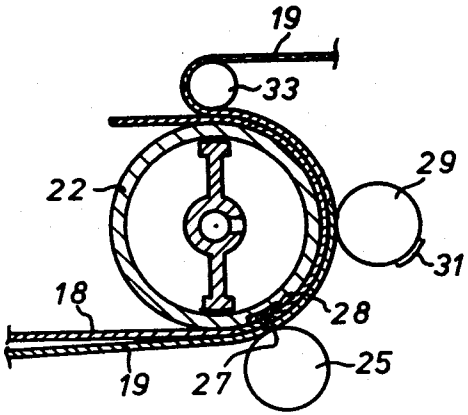

Referring to FIG. 2, it may be seen that the fresh web 18, for instance a web of polyethylene terephthalate as used in the photographic industry as a support in the manufacture of light-sensitive material, has already been introduced in the nip between the progressing web 19, which may be of the same material, and the vacuum roller 22, and that said web 18 is firmly sandwiched between the web 19 and the roller surface by the tension of the web 19 which is being pulled by web transport rollers from a web roll positioned in the station 12, and braked by appropriate control of the friction of the unwinding roll 17 (see FIG. 1). The rollers 25 and 29 have been moved towards the vaccum roller 22 in the angular position as shown, so that the knife 27 co-operates with the plate 28 to simultaneously cut the two webs.

Upon continued rotation of the rollers, the freshly cut leading end of the web 19 follows a path as indicated by the numeral 60 (FIG. 3) whereas the trailing end of said web, ahead of the line of cut, is free to move away from the web 18 in the zone between the roller 25 and the roller 29. As said trailing end of the web 19, however, becomes seized between the roller 29 and the vacuum roller 22, the intimate contact of the trailing end of the web 19 with the web 18 is restored. A relative movement between the two webs during the transport from the roller 25 to the roller 29 does not occur, since both webs remain in firm contact with each other over the arc of the vacuum roller extending from the roller 29 to the roller 33.

Figure 3:
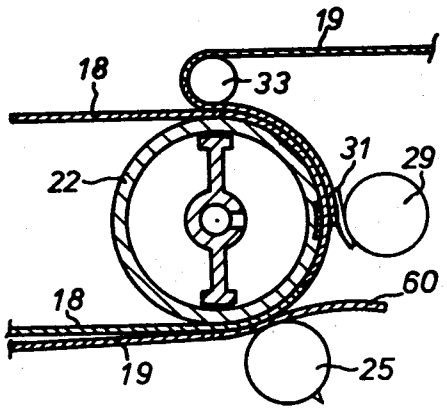

The taping of the two webs is illustrated in FIG. 3, wherein it may be seen that the tape 31 has already been applied to the trailing end of the web 19. Upon further rotation of the rollers 22 and 29, the lower half of the tape will be applied to the leading end of the web 18. The enlarged scale on which the webs and the tape have been drawn may give the impression that the lower half of the tape will not contact the web 18, but it will be understood that actually the thickness of the web and tape is much smaller as compared with the size of the rollers, and also that as a consequence of the pressure exerted by the roller 29, the tape will be smoothly and progressively applied to the leading end of the web 18 upon continued advance of the webs. The fixing of the tape to the roller 29 is arranged in a known way so that the tape is easily released from the roller 29 by the adherence of the adhesive side of the tape to the web ends.

It should be noted that after the cutting of the web 19, the trailing end portion of said web which is ahead of the line of cut does not slip over the web 18, and this notwithstanding the fact that the braking force caused by the unwinding roll 17 ceased to exist, since the roller 29 continues to operate as a pressure roller in co-operation with the roller 22, before the moment that the tape 31 is applied to the webs.

Figure 4:
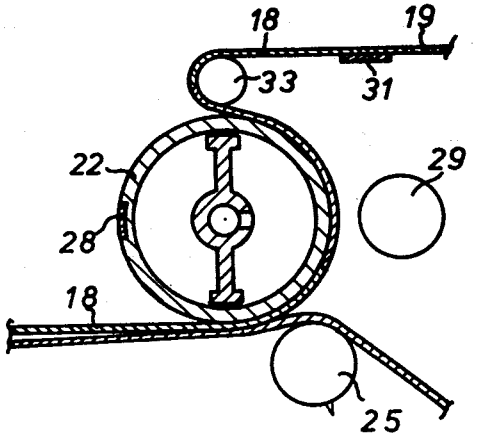

Immediately after the web-joining has been performed, the rollers 25 and 29 are withdrawn from the roller 22 and returned into their inoperative position as illustrated in FIG. 4 where it may be seen that in the meantime the web splice with the tape 31 has been advanced up to the righthand side of the roller 33. During the mentioned advance of the splice, the end of the web 18 which was adhead of the splice becomes removed from between the web 19 and the roller 22, whilst the end of the web 19, at the upstream side of the splice, may be fed to a suitable collecting station.

Figure 5:
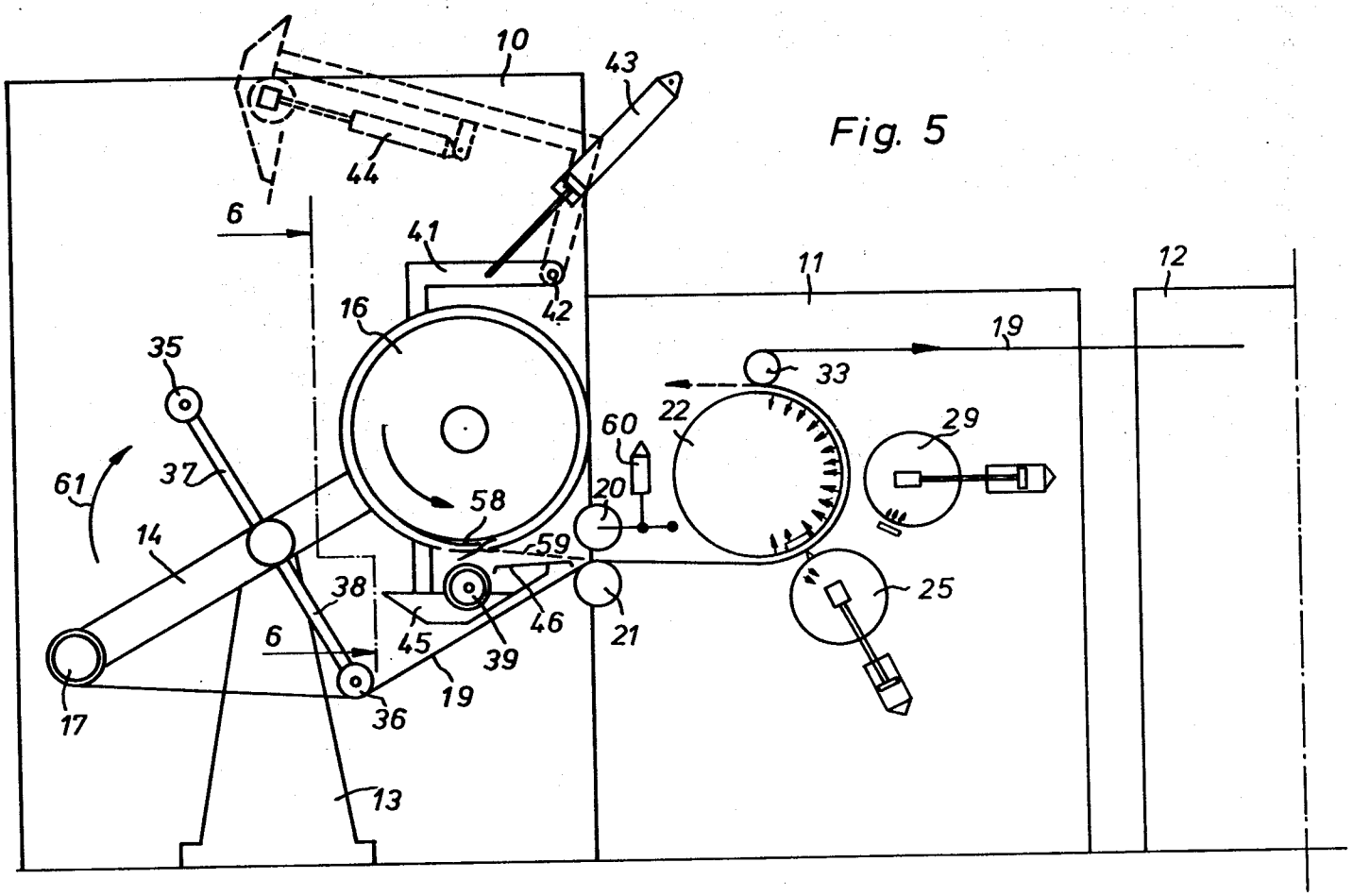
FIG. 5 is a diagrammatic illustration of a mechanism for treating the leading end of the fresh web.
Figure 6:
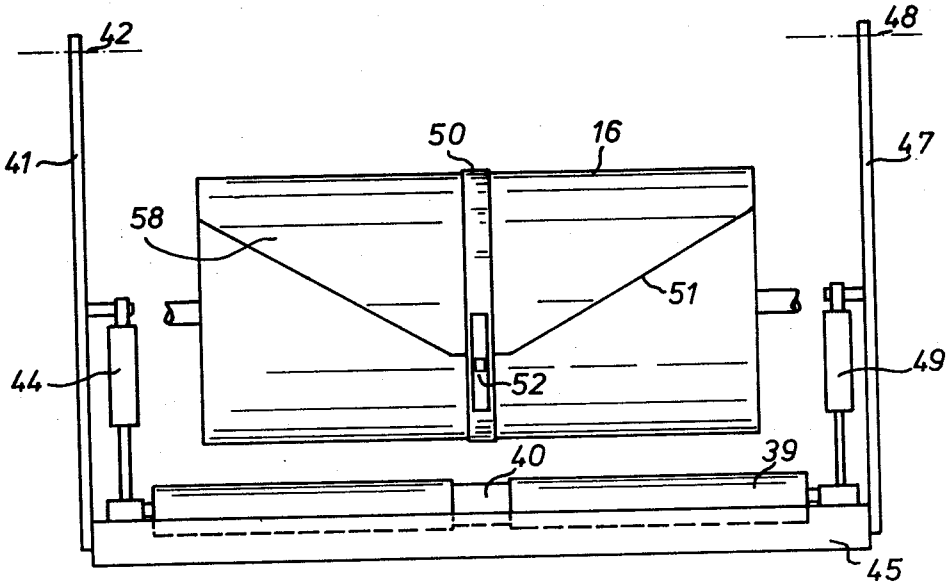
FIG. 6 is a view on line 6—6 of FIG. 5.

In the description of the operation of the apparatus hereinbefore, it was said that the fresh web 18 was already introduced between the progressing web 19 and the vacuum roller 22 upon the starting of the splicing operation. Although there exist other devices known in the art for carrying out the mentioned roll introduction, the novel mechanism which is illustrated in FIGS. 5 and 6 has proved to be particularly suited for presenting the leading end of a roll of a fresh web.

The mechanism comprises two additional guide rollers 35 and 36 which are mounted between arms such as the arms 37 and 38 which are fitted at right angles to the arm 14 of the unwinder 13. A roller 39 which extends over the width of the web and which has a peripheral groove 40 situated midway of the length of said roller, as illustrated in FIG. 6, is journalled for free rotation between two laterally spaced L-shaped arms 41 and 47. The arms are pivotable about points 42 and 48 and may be swung by an air cylinder such as cylinder 43 from an operative position as shown in drawn lines, into an inoperative position shown in broken lines. The roller 39 is mounted for bodily displacement in a direction parallel with the longer legs of the arms 41 and 47 under the control of air cylinders such as 44 and 49. Below the roller 39 are mounted a tray 45 and a guide plate 46 between the extremities of the arms 41 and 47.

The central portion of the guide plate 46 is cut away, not shown in the drawing, in order to permit the band 50 which will now be described, to drop into the tray 45 after its detachment.

The roll 16 containing the fresh web 18 is provided with a band 50 of an elastic material which may have a width of a few centimeters, and which is tensioned about the middle of the roll to fix the leading end 58 of the web which has been cut in the form of a V as indicated by the numeral 51. One end of the band is provided with a clip 52, as shown on an enlarged scale in the sectional view of FIG. 7, said clip comprising a base plate 53 that is fixedly attached to the left-hand end of the band 50, and a lever which is pivotally mounted on said base plate and of which the lever parts situated at opposite sides of the pivot point of the lever, are indicated by numerals 54 and 55, respectively. The lever part 55 is provided with a pin 56 that may pass through a corresponding hole in the right-hand end of the band 50.

Figure 7:
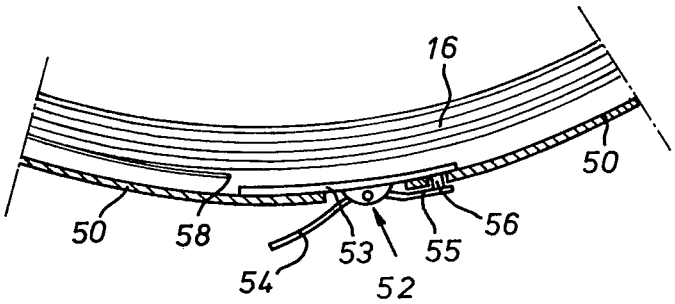
FIG. 7 is an enlarged view of a band for securing the windings of a fresh web wound up on a roll.

The band is fitted in such a way about the roll 16 that the clip 52 slightly precedes the leading edge of the end 58 of the web on the roll 16. In the drawing of FIG. 7, the band 50 has been drawn separated from the roll 16 for illustrative purposes.

The operation of the described mechanism is as follows. When the roll 17 of the progressing web 19 is almost unwound, a drive mechanism which may be incorporated into the unwinder is started for rotating the roll 16 until the peripheral speed of the roll equals the speed of the progressing web 19. Means known in the art for adjusting the speed of said roll may comprise a small tachometer with a measuring roller which engages the periphery of the roll 16, the output signal of which tachometer is fed to a controller controlling the motor driving the roll 16. The moment at which only a very few web windings remain on the roll 17 may be detected by means known in the art, and at such moment the air cylinders 44 and 49 are controlled to raise the roller 39 until it resiliently contacts the roll 16. After at most one further revolution of the roll 16 the clip 52 becomes pressed between the roll 16 and the recessed portion 40 of the roller 39 so that the lever part 54 is pushed towards the band 50 whereby the clip is opened and the band 50 is detached. Since the band was firmly tensioned about the roll, its sudden release causes the band to rapidly disengage from the roll and upon continued rotation of the roll 16 the band is pulled between the nip of the roll 16 and the roller section 40 until it drops in the portion of the tray 45 that is situated at the right-hand side of the roller 39. The leading end 58 of the web of roll 16 follows an almost straight path up from the nip between the roll 16 and the roller 39 as indicated by the broken line 59 under the combined influences of the tendency of the web to assume a non-curved position, of gravity acting on the unsupported web end, and of an overpressure of air between the leading web end and the roller periphery, which is due to the peripheral roll speed. The guide plate 46 guides the web properly between the rollers 20 and 21 which may be arranged for temporary movement away from each other under the action of an air cylinder such as the cylinder 60 in order to not impede the proper advance of the leading web end until this has been gripped between the roller 22 and the web 19.

As soon as the leading end of the new web has been properly gripped, the roller 39 is lowered, the roller pair 20, 21 is closed and the splicing operation can start.

Once the webs have been spliced, the mechanism comprising the arms 41 and 47 is swung into the inoperative position so that, after the empty core of roll 17 has been replaced by a fresh roll of web material and after the diameter of roll 16 has been reduced to permit pivotation past the rollers 20 and 21, the unwinder may be rotated in the direction of the arrow 61 over 180 angular degrees.

In the description of the butt-splicer hereinbefore, reference was made to air cylinders for the actuation of the different members. It will be understood that other displacement means known in the art may be used as well, and we refer to hydraulic cylinders, cam and cam-follower mechanisms, electric motors with coupled reduction gears, etc.

The control of the different motors may occur manually, but it will be understood that automatic control thereof is preferred, either according to a technique wherein a central programmer mechanism determines the timed sequence of the different operations, or in accordance with a technique wherein the termination of one operation automatically involves, occasionally through an appropriate delay mechanism, the starting of one or more other operations which, in their turn control the next operation(s), etc.

The web-supporting roller 22 has been described as a vacuum roller in the illustrated example. It will be understood that alternative mechanisms may be used to retain the leading end of the fresh web on the roller in those cases where the nature of the webs can allow it. For instance, webs which are readily electrostatically attracted may be adhered to the roller by establishing an electrostatic potential difference between the web and the roller, and webs which are rather flexible may be kept on the surface of said web-supporting roller by directing air-jets produced by air nozzles situated between the cutter and the tape applicator, on the outside surface of the progressive web.

As mentioned already hereinbefore, the mechanism for the treatment of the leading end of the fresh web may be replaced by other mechanisms of the type known in the art, such as air jets, opposed endless belts mechanism, etc. for controlling the path of said leading end towards the web-supporting roller 22.

The roller 25 of the web cutter 23 may be provided with a peripheral vacuum section as indicated by the series of small arrows in FIG. 5, in order to more positively grip and remove the remaining portion of the progressing web 19 between the rollers 25 and 29 along a path such as indicated by the numeral 60 in FIG. 3.

The web-supporting roller 22 has been described as being non-driven in the description. It will be understood that said roller may also be driven in peripheral synchronism with web transport rollers in a station such as the station 12, and such positive driving of the roller 22 will even be preferred in those cases where very accurate splices are preferred or required. The apparatus according to the invention is not limited to the splicing of webs of polyethylene terephthalate as mentioned hereinbefore but may also be used for the treatment of other plastic webs and for webs of paper, metal, laminated materials, either coated or uncoated.

We claim:

1. A butt-splicer apparatus for butt-joining a fresh web to a running web without interruption of the motion of the running web, said apparatus comprising:

a rotatable cylindrical web-supporting roller having perforations around its periphery and means for creating a vacuum in at least a segmental portion of its periphery, guide means for guiding said running web at least during a splicing operation along a path which extends into tangential contact with a point on the peripheral path of said roller and then wraps downstream from said tangential point around a predetermined arcuate portion equal to at least about 90° of the roller periphery, whereby the running web is biased against the roller periphery by the running tension therein, said arcuate portion including said segmental portion in which said vacuum is created, means for delivering the leading end of the fresh web into the convergence between the said web-supporting roller and the immediately upstream region of the running web while said running web is passing through said path wrapped around said roller, whereby the fresh web end is engaged and held between the tensioned running web and the contiguous arcuate roller peripheral portion to advance the same, a rotatable cutter disposed adjacent the web-supporting roller periphery at a locus within said predetermined arcuate portion, said cutter being operable to be brought into pressing contact with the running web surface to cut both webs generally transversely along a common line while both are supported on the roller surface, and a rotatable tape applicator which is disposed adjacent the web-supporting roller peripheray at a locus downstream of said cutter but within said predetermined arcuate portion of said periphery, said applicator being operable to be brought into pressing contact with the exposed surfaces of the margins of both webs adjacent said common cutting line to apply a tape splice thereto.

2. A butt-splicer according to claim 1, wherein said web-supporting roller is driven at a peripheral speed corresponding with the linear speed at which the running web is pulled away.

3. A butt-splicer according to claim 1, wherein said rotatable cutter is formed by a knife which is fitted to a rotatable roller, and which can co-operate with a cutter base plate carried on the periphery of the web-supporting roller.

4. A butt-splicer apparatus for butt-joining a fresh web to a running web without interruption of the motion of the running web, said apparatus comprising:

a rotatable cylindrical web-supporting roller, a guide means for guiding said running web at least during a splicing operation along a path which extends into tangential contact with a point on the peripheral path of said roller and then wraps downstream from said tengential point around a predetermined arcuate portion of the roller periphery of substantial extent, whereby the running web is biased against the roller periphery by the running tension therein, means for delivering the leading end of the fresh web into the convergence between the said web-supporting roller and the immediately upstream region of the running web while said running web is passing through said path wrapped around said roller, whereby the fresh web end is engaged and held between the tensioned running web and the contiguous arcuate roller peripheral portion to advance the same, a rotatable cutter disposed adjacent the web-supporting roller periphery at a locus within said predetermined arcuate portion, said cutter being operable to be brought into pressing contact with the running web surface to cut both webs generally transversely along a common line while both are supported on the roller surface, and a rotatable tape applicator which is disposed adjacent the web-supporting roller periphery at a locus downstream of said cutter but within said predetermined arcuate portion of said periphery, said applicator being operable to be brought into pressing contact with the exposed surfaces of the margins of both webs adjacent said common cutting line to apply a tape splice thereto, said means for delivering the web end of the fresh web into the convergence between said web-supporting roller and said running web comprising a belt-like band which is wrapped about the roll of fresh web to secure the windings thereof in place, clip means for attaching the ends of said band to each other, means arranged for contact with the said roll of fresh web thereby to open said clip and detach the band upon passage of the clip through the nip between said means and said roll, and at least one guide for guiding the leading end of the web upon its detachment from the roll.

5. A butt-splicer according to claim 4, wherein said band is of an elastic material so that it may be firmly tensioned about the roll.

6. A butt-splicer according to claim 4, wherein said banddetaching means is in the form of a rotatable roller which runs parallel with said roll of fresh web and has a section of reduced diameter, thereby to facilitate the passage of the clip of said band around said roll of fresh web.

7. In a butt-splicing method in which a fresh web is introduced in sandwiched relation to a running web, both webs are cut along a common line extending generally transversely of their width, and a length of tape is applied across the joint to splice the same: the improvement comprising the steps of guiding said running web at least during a splicing operation into tangential contact with the perforated periphery of a cylindrical roller and then around a substantially arcuate portion equal to at least about 90° of the roller periphery beneath which portion a vacuum is maintained, and webs being cut and the splicing tape applied thereto along said arcuate portion; and while the running web is so guided and under running tension, delivering the leading end of the fresh web into the convergence between said roller periphery and the region of the running web directly upstream of the point of tengential contact therewith, whereby the fresh web end is pinched between the roller periphery and the facing surface of the tensioned running web and is advanced therewith.

* * * * *